US007181876B1

(12) United States Patent
Ahmadi

(10) Patent No.: US 7,181,876 B1
(45) Date of Patent: Feb. 27, 2007

(54) LED SIGN VISIBILITY ENHANCING DEVICE

(76) Inventor: William Y. Ahmadi, 7301 Lennox Ave., Unit B14, Van Nuys, CA (US) 91405

( * ) Notice: Subject to any disclaimer, the term of this patent is extended or adjusted under 35 U.S.C. 154(b) by 0 days.

(21) Appl. No.: 10/369,948

(22) Filed: Feb. 20, 2003

Related U.S. Application Data

(60) Provisional application No. 60/358,022, filed on Feb. 20, 2002.

(51) Int. Cl.
*G09F 13/04* (2006.01)

(52) U.S. Cl. ..... 40/572; 40/564; 40/617

(58) Field of Classification Search ..... 40/564, 40/572, 612, 617, 716
See application file for complete search history.

(56) References Cited

U.S. PATENT DOCUMENTS 2,769,263 A * 11/1956 Wamser ..... 40/574
4,718,185 A * 1/1988 Conlin et al. ..... 40/442
5,309,656 A * 5/1994 Montgomery ..... 40/442
5,428,912 A * 7/1995 Grondal et al. ..... 40/570
6,263,601 B1 * 7/2001 Emert ..... 40/564
6,299,325 B1 * 10/2001 Cathel ..... 362/183
6,582,103 B1 * 6/2003 Popovich et al. ..... 362/307
6,594,931 B1 * 7/2003 Barton et al. ..... 40/552

* cited by examiner

*Primary Examiner*—Gary C. Hoge
(74) *Attorney, Agent, or Firm*—Strategic Intellectual Property Group

(57) ABSTRACT

A lighting system for a sign consists of a bracket to be attached to the top of a flat sign, the bracket including a surface supporting a battery, a solar battery charging cell and a circuit connecting the battery to an LED lamp directed to illuminate the message on the sign. A second embodiment includes a box-type sign with a housing having a light-transmitting top panel, a message on both side panels, light-transmitting ends, and either one or two mirrors supported on the bottom angled to reflect light against the messages. A support bracket includes straps extending part way across the top panel carrying solar panels, batteries, and a circuit are located under the straps and one or more LED lamps are connected to the circuit and arranged to be powered when the ambient light becomes too low to properly illuminate the message or messages.

9 Claims, 2 Drawing Sheets

LED SIGN VISIBILITY ENHANCING DEVICE

REFERENCE TO RELATED APPLICATION

This Non-Provisional Patent Application claims benefit of U.S. Provisional Patent Application Ser. No. 60/358,022 filed Feb. 20, 2002, and hereby claims the benefit of the embodiments therein and of the filing date thereof.

BACKGROUND OF THE INVENTION

There are many types and varieties of illuminated signs, some of which have translucent panels with an opaque message with a background which is illuminated by lamps from behind. Others are just opposite wherein light from lamps on the inside shine through transparent or translucent letters or numerals. Some are painted signs illuminated from the front from above or below. One common type of sign is referred to as a box sign because it is in the form of a box with lamps, either inside or on the outside directed toward a front panel carrying its message. Some such signs may carry a message on both sides.

There are some disadvantages to such signs for highway or roadway use because lamps can burn out leaving the sign dark and, in many cases, illegible or illegible at a desired distance. Either incandescent or fluorescent lamps connected to the main power source from an electric utility company may stop working at almost any time either from power outages or burned-out lamps. Replacing of lamps and other servicing of such signs is expensive and time consuming. Dirt and dust are a problem and wiring can be damaged from heavy storms, hail, etc. The amount of electrical energy consumed by such incandescent or fluorescent lamps is also a disadvantage.

There is, therefore, a need for illuminated highway or roadway signs which are more reliable, more effective, and less expensive to operate than signs presently in use.

Light-emitting diodes have been used in some signs as illustrated by U.S. Pat. Nos.:

5,964,051

5,469,347 and 5,388,357

Solar powered signs are typified by U.S. Pat. No. 4,484,104.

BRIEF SUMMARY OF THE INVENTION

The applicant has found that the usual highway or roadway sign can be considerably improved through the use of prismatic materials in forming the message or as a background for opaque materials used for the message of such signs. Prismatic glass, acrylic plastic materials or other light-enhancing materials may be used to enhance the visibility of the message on the sign. A mirror or mirrors or other suitable reflecting surfaces within the sign will reflect ambient light coming through a transparent top and ends of the sign to provide adequate visibility of the message even in limited light.

When it becomes dark, such signs do require additional means to illuminate the message. Rather than connect the sign to an external power source, such as an electrical utility power grid, applicant has found that a self-contained lighting system containing a battery, a solar panel to charge the battery, an electrical circuit connected to the battery, and a few well-placed LEDs (light-emitting diodes) connected to the electrical circuit is adequate to keep the message on the sign visible throughout the darkness hours, while enhancing illumination during the day. A switching device may form part of the electrical circuit responds to the level of ambient light to switch the LEDs on and off. LEDs have been found to be highly reliable, long lasting, and are capable of supplying the level of illumination required.

A unique support system not only holds the sign attached to any available support for the entire fixture but further:

a) provides only minimum interference with solar illumination through a top window;

b) supports solar-collecting devices;

c) supports a battery and any timer or electrical equipment; and d) may also support LEDs or other lamps.

DESCRIPTION OF THE PREFERRED EMBODIMENTS

Figure 1:
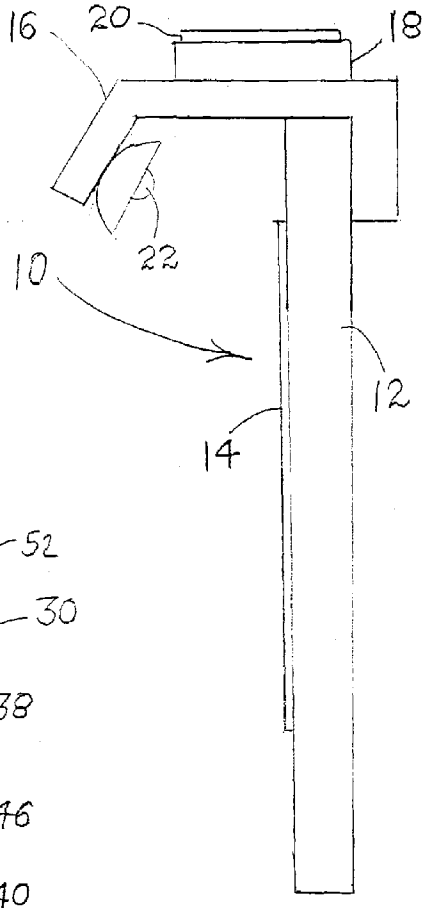
FIG. 1 is a side elevational view of a flat roadway sign according to the invention, including the LED sign visibility enhancing system.

FIG. 1 is a side elevational view of a flat roadway sign, generally designated 10, including a face panel 12 carrying a message 14. Secured to panel 12 is a bracket 16 which carries an electrical assembly 18, including an electrical circuit CT and a solar panel 20. Electrically connected to electrical assembly 18 is a lamp consisting of one or more LEDs 22 with optional reflectors 22A.

Electrical assembly 18 includes connections to LED 22, a battery B showing in dashed lines within assembly 18, which is connected to be charged to solar panel 20, and a switching circuit SC responsive to the level of ambient light for powering the LEDs 22 on at the end of the day when ambient light is inadequate to see the message 14 and to turn it off in the morning.

During the pendency of the above-referenced Provisional Patent Application, I conceived of the application of this invention to box type internally or back lit signs, whereby such signs may be supported, employ ambient backlighting, or solar-powered LED illumination, as well. Such an embodiment is shown in FIG. 2.

Figure 2:
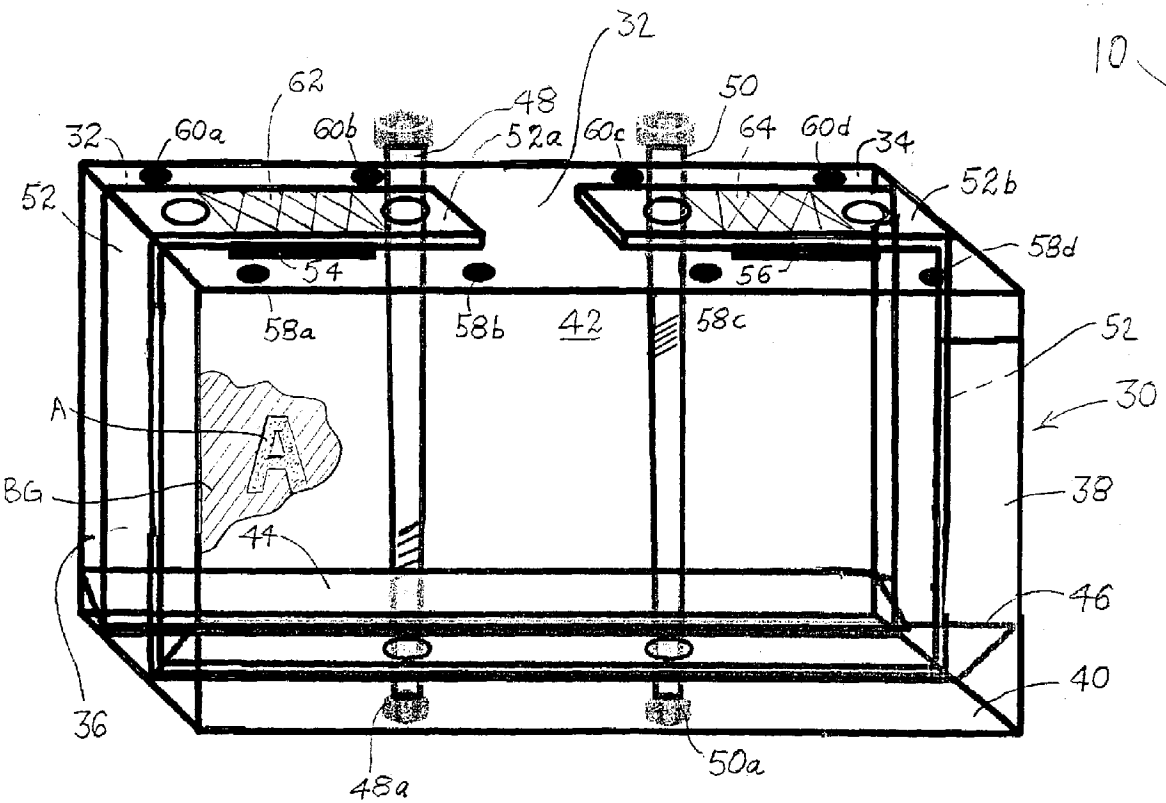
FIG. 2 is a perspective view of a box-type roadway sign according to the invention including the LED sign visibility enhancing system.
Figure 3:
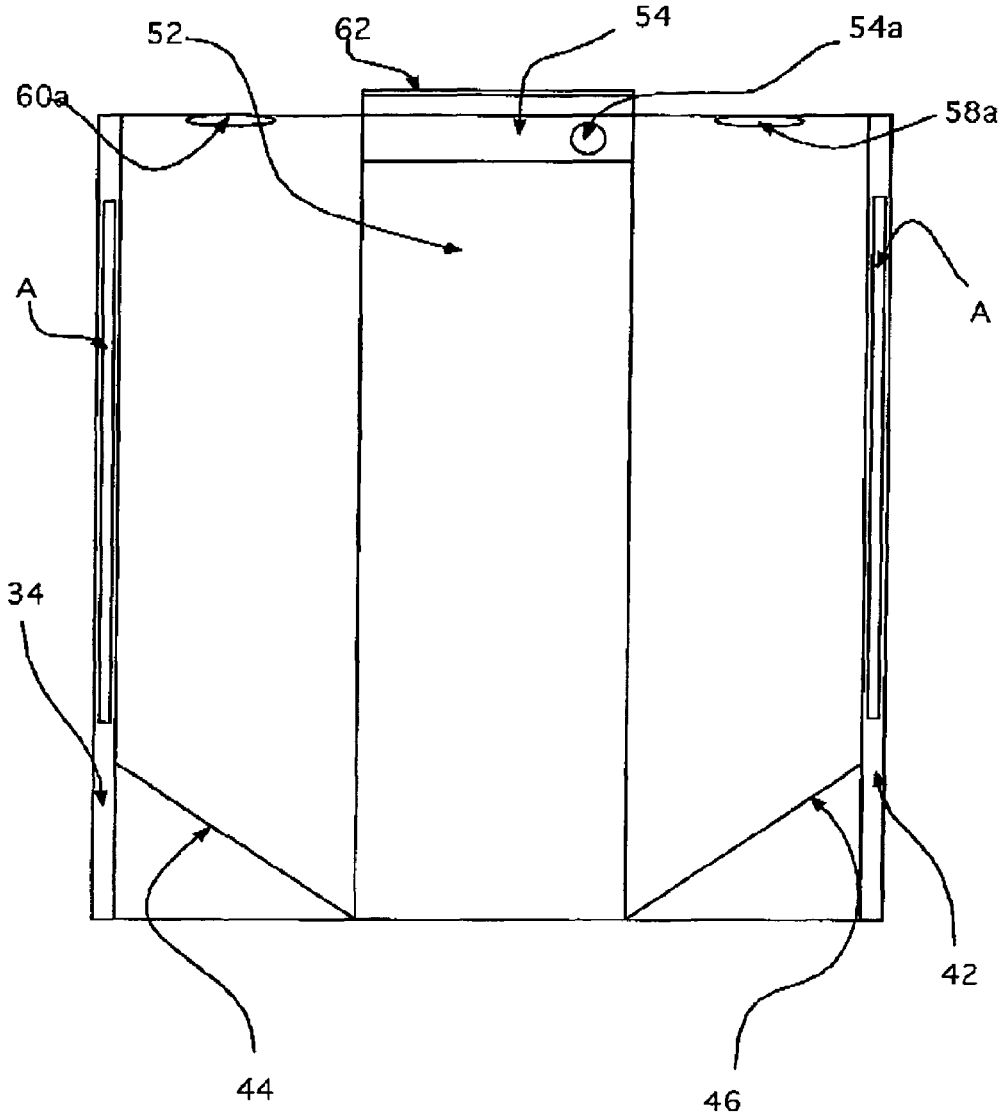
FIG. 3 is a cross-sectional view of the box-type roadway sign in FIG. 2.

FIG. 2 and FIG. 3, are a perspective view and a cross-sectional view, respectively, of a box-type sign 30 commonly used for elevated positions over a roadway or highway. Sign 30 includes a top panel 32 which is either clear or of prismatic material, such as glass or an acrylic plastic which contains a large number of light-gathering surfaces and which transmits a substantial amount of ambient light to its interior. Sign 30 also includes a back panel 34, end panels 36 and 38, a bottom panel 40, and a face panel 42. Preferably, at least end panels 36 and 38 are of prismatic material or other light-enhancing material.

Bottom panel 40 carries two mirrors or light-reflecting surfaces 44 and 46 which are angled from the bottom panel 40 to reflect light entering box sign 30 though any of the light transmitting or prismatic surfaces, such as top panel 32 or end panels 36 and 38. Mirror 44 reflects light against face panel 42, and mirror 46 reflects light toward rear panel 34. Rear panel 34 may also contain a message A, as illustrated in FIG. 3. The messages, such as the letter A, on face panel 42 or rear panel 34, as in FIG. 3, may be formed of prismatic material on an opaque background BG or vice versa.

Support means for the sign 30 includes an enclosing bracket 52, a pair of bolts 48 and 50, which pass through top panel 32 and are secured to bottom panel 40. Nuts or bolt heads 48A and 50A pull up against a bracket 52 which extends across sign 30 below bottom 40, wraps up over end panels 36 and 38, and extends part way across top panel 32 from each side. Other suspending means may be secured to the top ends of bolts 48 and 50.

Located between extensions 52*a* and 52*b* of bracket 52 and top panel 32, preferably within the box 30, are circuit boxes 54 and 56 which contain batteries, 54*a* and 56*a*, respectively and which are connected to a series of LEDs 58*a*, 58*b*, 58*c*, 58*d*, 60*a*, 60*b*, 60*c*, and 60*d*. Located on the top of racket extensions 52*a* and 52*b* are solar cells 62 and 64, which respond to sunlight to charge the batteries in circuit boxes 54 and 56. FIG. 3 illustrates the circuit box 54 and its component battery 54*a*, connected to the solar cell 62.

The bracket 52 with its support bolts 48 and 50 may be attached to any typical street sign or street lighting post and arm or attached to any available overhead structure.

In addition to supporting the entire sign box, the bracket 52 and bolts only cover a small area of the top of the box 30. The parts of the bracket 52 which partially obscure the clear or prismatic cover 32 is used to support solar cells 62 and 64 where they are not visible to vandals and washed with each rain. The bracket 52 and the cover 32 on their underside support the battery B and electrical package 18 from the elements.

The LEDs 58 and 60 are supported within the box 30 from either the bracket 52 or the top 32 alone.

Altogether, the combination of bracket 52, bolts 48 and 50, solar panels 62 and 64, battery B, control circuit 56, and selected clear or prismatic panels provide a unique combination ambient and solar panel/battery-powered LED illuminated sign.

The above-described embodiments of the present invention are merely descriptive of its principles and are not to be considered limiting. The scope of the present invention instead shall be determined from the scope of the following claims including their equivalents.

I claim:

1. A roadway sign comprising; a housing including a top panel, a bottom panel, a rear panel, two end panels, and a face panel, said face panel including a message and a background, one of said message and said background being of prismatic material;

said top panel and said end panels being light transmitting;

a mirror supported on said bottom panel at an angle effective to reflect light against said message;

at least one of said face and rear panels including partially light-transmitting sections;

a support bracket for said sign including straps extending at least part of the distance across said top panel;

a battery supported by said support bracket;

a solar panel supported on said support bracket connected to said battery;

an electrical circuit connected to said battery;

at least one LED lamp in said sign connected to be powered by providing illumination inside said sign; and wherein said top panel provides ambient rear lighting for the message supplemented by solar powered LED lighting.

2. A roadway sign as in claim 1, in which a message appears on both said face panel and said rear panel and separate mirrors are supported on said bottom panel at angles effective to reflect light against said messages.

3. A roadway sign as in claim 1, further comprising a plurality of metal rods secured to said bracket for supporting said sign.

4. A roadway sign as in claim 1, wherein said two end panels are comprised of prismatic material.

5. A roadway sign elevated above the level of a roadway comprising: a housing including a top panel, a bottom panel, two end panels, a rear panel, and a face panel, said face panel including a message and a background, one of said message and said background being of light-enhancing material;

said top panel being of light-transmitting material;

a mirror in said housing supported at an angle relative to said bottom panel effective to reflect light against said face panel to enhance the visibility of said message;

a support bracket for said sign including straps extending at least part way across said top panel;

a battery carried on said support bracket;

a solar panel carried on said straps connected to said battery;

an electrical circuit connected to said battery; and a plurality of LED lamps inside said housing connected to said electrical circuit for illuminating said mirror and said message on said face panel.

6. A roadway sign as in claim 5, further comprising a message on said rear panel and a separate mirror are positioned to reflect light against said rear panel.

7. A roadway sign as in claim 5, further comprising an electrical circuit with switching means responsive to a diminished level of ambient light for connecting said battery to said LED lamp.

8. A roadway sign as in claim 5, further comprising a plurality of metal rods extending through said support bracket from below said support bracket and also though said straps for supporting said sign.

9. A roadway sign as in claim 5, wherein said two end panels are comprised of prismatic material.

* * * * *